United States Patent [19]

Derr et al.

[11] 4,435,275

[45] Mar. 6, 1984

[54] HYDROCRACKING PROCESS FOR AROMATICS PRODUCTION

[75] Inventors: Walter R. Derr, Voorhees; Michael S. Sarli, Haddonfield, both of N.J.

[73] Assignee: Mobil Oil Corporation, New York, N.Y.

[21] Appl. No.: 375,075

[22] Filed: May 5, 1982

[51] Int. Cl.[3] ..... C10G 47/16; C10G 65/02

[52] U.S. Cl. ..... 208/89; 208/111

[58] Field of Search ..... 208/89, 111, 57, 95, 208/137

[56] References Cited

U.S. PATENT DOCUMENTS

| | | | |
|---|---|---|---|
| 3,159,568 | 12/1964 | Price et al. | 208/89 |
| 3,256,177 | 6/1966 | Tulleners | 208/89 |
| 3,620,964 | 11/1971 | Stover | 208/111 |
| 3,794,580 | 2/1974 | Lapeur | 208/110 |
| 4,149,960 | 4/1979 | Garwood et al. | 208/111 |
| 4,153,540 | 5/1979 | Gorring et al. | 208/89 |
| 4,211,634 | 7/1980 | Bertolacini et al. | 208/59 |
| 4,211,635 | 7/1980 | Chen | 208/93 |
| 4,302,323 | 11/1981 | Chen | 208/89 |
| 4,313,817 | 4/1982 | Mayer et al. | 208/89 |

FOREIGN PATENT DOCUMENTS

| | | | |
|---|---|---|---|
| 44-31216 | 12/1969 | Japan | 208/89 |

OTHER PUBLICATIONS

"Use of Zeolite Containing Catalysis in Hydrocracking," Marcilly and Franck pp. 93-103 in the Book: Catalysis by Zeolite Elsevier Amsterdam, 1980.

*Primary Examiner*—Delbert E. Gantz
*Assistant Examiner*—Geo. Schmitkons
*Attorney, Agent, or Firm*—Alexander J. McKillop; Michael G. Gilman; Dennis P. Santini

[57] ABSTRACT

A hydrocracking process with improved distillate selectivity is operated at limited conversion without liquid/gas separation between the denitrogenation and hydrocracking catalyst beds or liquid recycle. Conversion is held to a maximum of 50 volume percent to lower boiling products. Relatively mild conditions, especially of pressure, may be employed.

14 Claims, 3 Drawing Figures

HYDROCRACKING PROCESS FOR AROMATICS PRODUCTION

FIELD OF THE INVENTION

This invention relates to hydrocracking and more particularly to a hydrocracking process with improved distillate selectivity.

THE PRIOR ART

Hydrocracking is a process which has achieved widespread use in petroleum refining for converting various petroleum fractions to lighter and more valuable products, especially gasoline and distillates such as jet fuels, diesel oils and heating oils. In the process, the heated petroleum feedstock is contacted with a catalyst which has both an acidic function and a hydrogenation function. In the first step of the reaction, the polycyclin aromatics in the feedstock are hydrogenated, after which cracking takes place together with further hydrogenation. Depending upon the severity of the reaction conditions, the polycyclic aromatics in the feedstock will by hydrocracked down to paraffinic materials or, under less severe conditions, to monocyclic aromatics as well as paraffins. During the process the nitrogen and sulfur containing impurities in the feedstock are converted to ammonia and hydrogen sulfide to yield sweetened products.

The acidic function in the catalyst is provided by a carrier such as alumina, silica-alumina, silica-magnesia or a crystalline zeolite such as faujasite, zeolite X, zeolite Y or mordenite. The zeolites have proved to be highly useful catalysts for this purpose because they possess a high degree of intrinsic cracking activity and, for this reason, are capable of producing a good yield of gasoline. They also possess a better resistance to nitrogen and sulfur compounds than the amorphous materials such as alumina and silica-alumina.

The hydrogenation function is provided by a metal or combination of metals. Noble metals of Group VIIIA of the Periodic Table (the Periodic Table used in this specification is the table approved by IUPAC and the U.S. National Bureau of Standards shown, for example, in the chart of the Fisher Scientific Company, Catalog No. 5-702-10), especially platinum or palladium may be used, as may base metals of Groups, IVA, VIA and VIIIA, especially chromium, molybdenum, tungsten, cobalt and nickel. Combinations of metals such as nickel-molybdenum, cobalt-molybdenum, cobalt-nickel, nickel-tungsten, cobalt-nickel-molybdenum and nickel-tungsten-titanium have been shown to be very effective and useful.

The two stages of the conventional process, hydrotreating and hydrocracking, may be combined, i.e., as in the Unicracking-JHC process, without any interstage separation of ammonia or hydrogen sulfide but the presence of large quantities of ammonia will result in a definite suppression of cracking activity which may, however, be compensated by an increase in temperature or by a decrease in space velocity. The selectivity of the zeolite catalysts used in this type of process remains, nevertheless, in favor of gasoline production at the conversion levels conventionally employed, typically over 70 percent, and generally higher.

SUMMARY OF THE INVENTION

It has now been found that the selectivity of the hydrocracking process to distillate production may be increased by operating the process at limited conversion. In the process we have developed, the feedstock is passed sequentially over hydrotreating catalyst and a hydrocracking catalyst without an intermediate separation of the ammonia or hydrogen sulfide formed in the hydrotreating. The feedstock is hydrocracked at limited conversion, not greater than 50 volume percent to distillate, to give a product with a relatively high content of aromatics which can be blended to make diesel fuels, heating oils and other valuable products.

The process may be operated at unconventionally low pressures, typically below 7000 kPa and at these relatively low pressures it has been found, surprisingly, that the hydrocracking activity may be maintained over long cycles, typically of the order of one year. In addition, the process may be operated in low pressure equipment not normally used for hydrocracking, for example, in a desulfurizer, and this enables the process to be put into operation with a low capital cost if suitable low pressure equipment is available.

DESCRIPTION OF PREFERRED EMBODIMENTS

Figure 1:
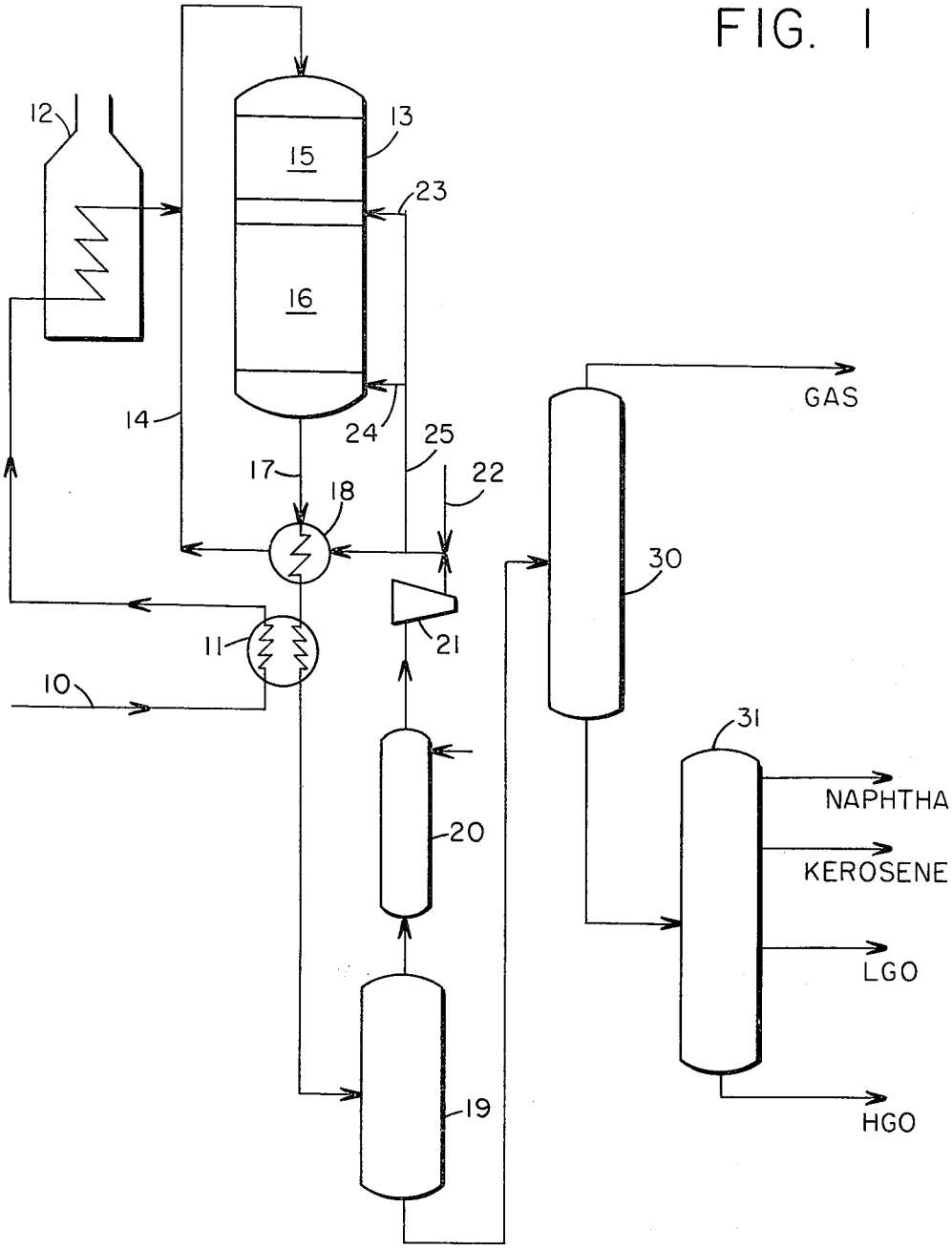
FIG. 1 is a simplified flowsheet showing one form of the hydrocracking process.

The process may suitably be operated in a system of the kind shown in simplified form in FIG. 1. Gas oil feedstock enters the system through line 10 and passes through heat exchanger 11 and then to heater 12 in which it is raised to a suitable temperature for the reaction. Prior to entering hydrocracker 13 the heated charge is mixed with preheated hydrogen from line 14. In hydrocracker 13 the charge passes downwardly through the two catalyst beds 15 and 16. The first bed, 15, contains a hydrotreating (denitrogenation) catalyst and the second bed, 16, the hydrocracking catalyst. The hydrocracker effluent passes out through line 17 to heat exchanger 18 in which it gives up heat to the hydrogen circulating in the hydrogen circuit. The effluent then passes to heat exchanger 11 in which the effluent gives up further heat to the gas oil feed. From heat exchanger 11 the cooled effluent passes to liquid/gas separator 19 which separates the hydrogen and gaseous products from the hydrocarbons in the effluent. The hydrogen passes from separator 19 to amine scrubber 20 in which the sulphur impurities are separated in the conventional manner. The purified hydrogen is then compressed to operating pressure in compressor 21 from which it enters the high pressure hydrogen circuit, with make-up hydrogen being added through line 22. Hydrocracker 13 is provided with hydrogen quench inlets 23 and 24 to control the exotherm and the temperature of the effluent. Inlets 23 and 24 are supplied from line 25. The hydrocracked product leaves separator 19 and then passes to stripper 30 in which gas ($C_{4-}$) is separated from liquid products which are fractionated in tower 31 to yield naptha, kerosene, light gas oil (LGO) and a heavy gas oil (HGO) bottoms fraction.

Feedstock

The feedstock for the process is a heavy oil fraction having an initial boiling point of 200° C. (400° F.) and normally of 340° C. (650° F.) or higher. Suitable feedstocks of this type include gas oils such as vacuum gas oil, or coker gas oil, visbreaker oil, deasphalted oil or catalytic cracker cycle oil. Normally, the feedstock will have an extended boiling range e.g. 340° to 590° C. (about 650° F. to 1100° F.) but may be of more limited ranges with certain feedstocks. For reasons which will be explained below, the nitrogen content is not critical; generally it will be in the range 200 to 1000 ppmw, and typically from 300 to 600 ppmw e.g. 500 ppmw. Likewise, the sulfur content is not critical and typically may range as high as 5 percent by weight. Sulfur contents of 2.0 to 3.0 percent by weight are common.

Process Conditions

General Process Conditions

The feedstock is heated to an elevated temperature and is then passed over the hydrotreating and hydrocracking catalysts in the presence of hydrogen. Because the thermodynamics of hydrocracking become unfavorable at temperatures above about 450° C. (about 850° F.) temperatures above this value will not normally be used. In addition, because the hydrotreating and hydrocracking reactions are exothermic, the feedstock need not be heated to the temperature desired in the catalyst bed which is normally in the range 360° C. to 440° C. (about 675° F. to 825° F.). At the beginning of the process cycle, the temperature employed will be at the lower end of this range but as the catalyst ages, the temperature may be increased in order to maintain the desired degree of activity.

The heavy oil feedstock is passed over the catalyst in the presence of hydrogen. The space velocity of the oil is usually in the range 0.1 to 10 LHSV, preferably 0.2 to 2.0 LHSV and the hydrogen circulation rate from 250 to 1000 n.1.1$^{-1}$. (about 1400 to 5600 SCF/bbl) and more usually from 300 to 800 (about 1685 to 4500 SCF/bbl). Hydrogen partial pressure is usually at least 75 percent of the total system pressure with reactor inlet pressures normally being in the range of 3550 to 10445 kPa (about 500 to 1500 psig), more commonly from 5250 to 7000 kPa (about 745 to 1000 psig). Because the process operates at low conversion, less than 50 volume percent conversion to 345° C.− (650° F.−) products, the pressure may be considerably lower than normal, according to conventional practices. We have found that pressures of 5250 to 7000 kPa (745 to 1000 psig) are satisfactory, as compared to the pressures of at least 10,500 kPa (about 1500 psig) normally used in commercial hydrocracking processes. However, if desired, low conversion may be obtained by suitable selection of other reaction parameters e.g., temperature, space velocity, choice of catalyst, even lower pressures may be used. Low pressures are desirable from the point of view of equipment design since less massive and consequently cheaper equipment will be adequate. Similarly, lower pressures usually influence less aromatic saturation and thereby permit economy in the total amount of hydrogen consumed in the process. However, certain catalysts may not be sufficiently active at very low pressures e.g., 3000 kPa (420 psig) and higher pressures may then be necessary at the space velocities desired in order to maintain a satisfactory throughput.

Hydrotreating

In the first stage of the process the feed is passed over a hydrotreating catalyst to convert nitrogen and sulfur containing compounds to gaseous ammonia and hydrogen sulfide. At this stage, hydrocracking is minimized but partial hydrogenation of polycyclic aromatics proceeds, together with a limited degree of conversion to lower boiling (345° C.−, 650° F.−) products. The catalyst used in this stage is a conventional denitrogenation catalyst. Catalysts of this type are relatively immune to poisoning by the nitrogenous and sulfurous impurities in the feedstock and, generally comprise a non-noble metal component supported on an amorphous, porous carrier such as silica, alumina, silica-alumina or silica-magnesia. Because extensive cracking is not desired in this stage of the process, the acidic functionality of the carrier may be relatively low compared to that of the subsequent hydrocracking catalyst. The metal component may be a single metal from Groups VIA and VIIIA of the Periodic Table such as nickel, cobalt, chromium, vanadium, molybdenum, tungsten, or a combination of metals such as nickel-molybdenum, cobalt-nickel-molybdenum, cobalt-molybdenum, nickel-tungsten or nickel-tungsten-titanium. Generally, the metal component will be selected for good hydrogen transfer activity; the catalyst as a whole will have good hydrogen transfer and minimal cracking characteristics. The catalyst should be pre-sulfided in the normal way in order to convert the metal component (usually impregnated into the carrier and converted to oxide) to the corresponding sulfide.

In the hydrotreating (denitrogenation) stage, the nitrogen and sulfur impurities are converted to ammonia and hydrogen sulfide. At the same time, the polycyclic aromatics are partially hydrogenated to form substituted aromatics which are more readily cracked in the second stage to form alkyl aromatics. Because only a limited degree of overall conversion is desired the effluent from the first stage is passed directly to the second or hydrocracking stage without the conventional interstage separation of ammonia or hydrogen sulfide, although hydrogen quenching may be carried out in order to control the effluent temperature and to control the catalyst temperature in the second stage.

Hydrocracking

In this stage, the effluent from the denitrogenation stage is passed over hydrocracking catalyst to crack partially hydrogenated aromatics and so to form substituted aromatics and paraffins from the cracking fragments. Conventional types of hydrocracking catalyst may be used but the preferred types employ a metal component on an acid zeolite support. Because the feed to this stage contains ammonia and sulphur compounds, the noble metals such as palladium and platinum are less preferred than the Group VIA and VIIIA base metals and metal combinations mentioned above as these base metals are less subject to poisoning. Preferred metal components are nickel-tungsten and nickel-molybdenum. The metal component should be pre-sulfided in the conventional manner.

The carrier for the hydrocracking catalyst may be an amorphous material, such as alumina or silica-alumina or an acidic zeolite, especially the large pore zeolites such as faujasite, zeolite X, zeolite Y, mordenite and zeolite ZSM-20, (all of which are known materials) or a combination of them. Zeolites have a high degree of acidic functionality which permits them to catalyze the cracking reactions readily. The degree of acidic functionality may be varied, if necessary, by conventional artifices such as steaming or alkali metal exchange (to reduce acidity) or ammonium exchange and calcining (to restore acidity). Because the hydrogenation functionality may also be varied by choice of metal and its relative quantity, the balance between the hydrogenation and cracking functions may be adjusted as circumstances require. The ammonia produced in the first stage will, to some degree, tend to reduce the acidic functionality of the hydrocracking catalyst but in the present process only a limited degree of conversion is desired and so the reduced cracking consequent upon the diminution of acidic functionality is not only acceptable but also useful.

The zeolite may be composited with a matrix in order to confer adequate physical strength, e.g. in its attrition resistance, crushing resistance and abrasion resistance. Suitable matrix materials include alumina, silica and silica-alumina. Other matrix materials are described in U.S. Pat. No. 3,620,964 to which reference is made for an exemplary listing of conventional compositing methods which may be used.

The metal component may be incorporated into the catalyst by impregnation or ion-exchange. Anionic complexes such as tungstate, metatungstate or orthovanadate are useful for impregnating certain metals while others may be impregnated with or exchanged from solutions of the metal in cationic form e.g. cationic complexes such as $Ni(NH_3)_6^{2+}$. A preferred method for incorporating the metal component into the zeolite and the matrix is described in U.S. Pat. No. 3,620,964, to which reference is made for details of the method.

The relative proportions of the hydrocracking and the hydrotreating catalysts may be varied according to the feedstock in order to cnvert the nitrogen in the feedstock to ammonia before the charge passes to the hydrocracking step; the object is to reduce the nitrogen level of the charge to a point where the desired degree of conversion by the hydrocracking catalyst is attained with the optimum combination of space velocity and reaction temperature. The greater the amount of nitrogen in the feed, the greater then will be the proportion of hydrotreating (denitrogenation) catalyst relative to the hydrocracking catalyst. If the amount of nitrogen in the feed is low, the catalyst ratio may be as low as 10:90 (by volume, denitrogenation:hydrocracking). In general, however, ratios between 25:75 to 75:25 will be used. With many stocks an approximately equal volume ratio will be suitable e.g. 40:60, 50:50 or 60:40.

Figure 2:
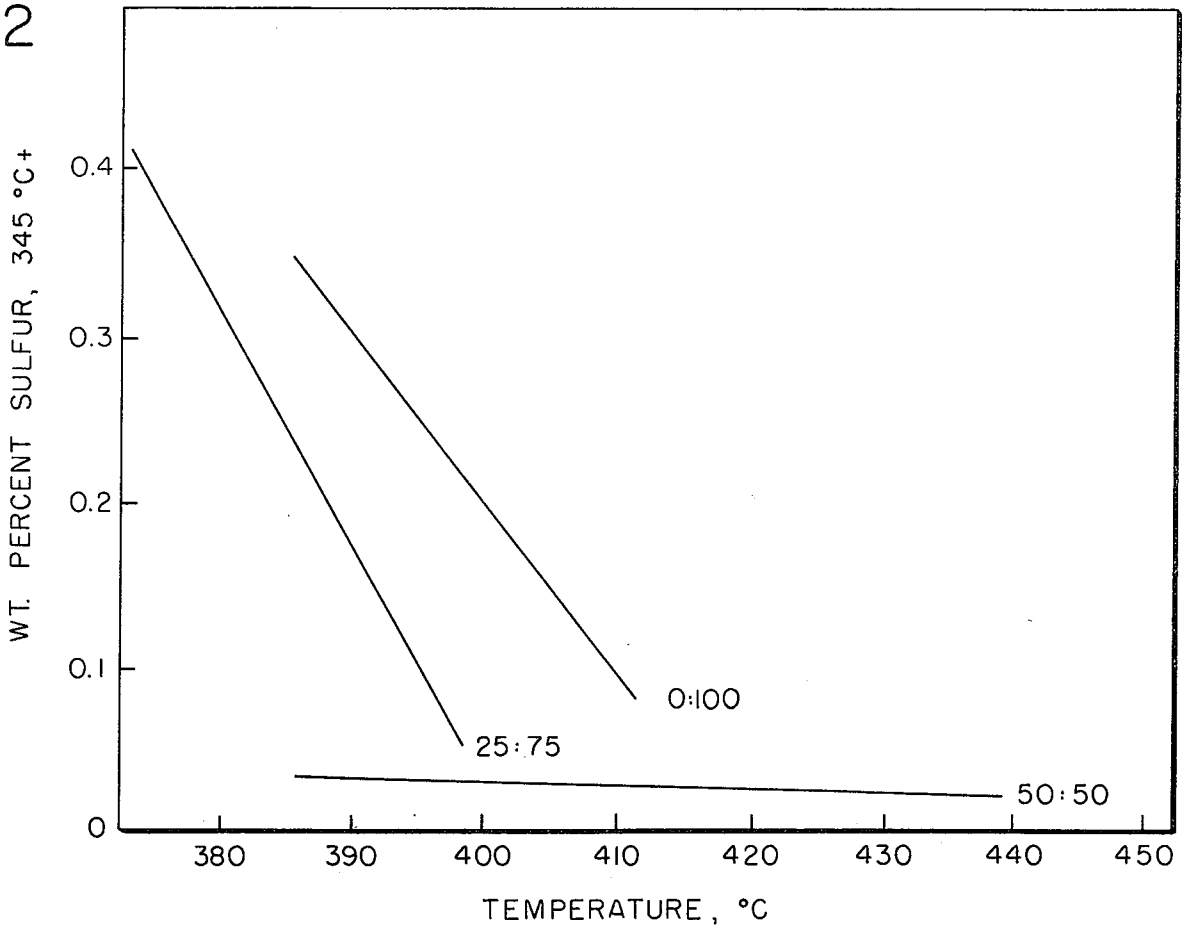
FIG. 2 is a graph relating the degree of desulfurization to the reaction temperature for three different catalyst combinations.

In addition to the denitrogenation function of the hydrotreating catalyst another and at least as important function is desulfurization since the sulfur content of the distillate product is one of the most important product specifications which have to be observed. The low sulfur products are more valuable and are often required by environmental regulation; the degree of desulfurization achieved is therefore of considerable significance. The degree of desulfurization obtained will be dependent in part upon the ratio of the hydrotreating catalyst to the hydrocracking catalyst and appropriate choice of the ratio will be an important factor in the selection of process conditions for a given feedstock and product specification. FIG. 2 shows that the degree of desulfurization increases as the proportion of the hydrotreating catalyst increases: the Figure shows the relationship between the sulfur content of the 345° C.+ (650° F.+) fraction and the reaction temperature for three different catalyst ratios (expressed as the volume ratio of the hydrotreating to the hydrocracking catalyst). The sulfur content of the 345° C.+ fraction is used as a measure of the desulfurization achieved; the sulfur content of the total liquid product will vary in the same manner, as will that of the distillate fraction although the latter will be much lower numerically. The hydrocracking catalyst is substantially poorer for desulfurization than the hydrotreating catalyst, but the lowest sulfur contents consistent with the required conversion may be obtained with an appropriate selection of the catalyst ratio. Another function of the hydrotreating catalyst is to aid in the saturation of polycyclic coke precursors and this, in turn, helps in extending the life of the hydrocracking catalyst.

The degree of desulfurization is, of course, dependent upon factors other than the choice of catalyst ratio. It has been found that the sulfur content of the distillate product is dependent in part upon the conversion and regulation of the conversion will therefore enable the sulfur content of the distillate to be further controlled: greater desulfurization is obtained at higher conversions and therefore the lowest sulfur content distillates will be obtained near the desired maximum conversion. Alternatively, it may be possible to increase the degree of desulfurization at a given conversion by raising the temperature of the hydrotreating bed while holding the temperature of the hydrocracking bed constant. This may be accomplished by appropriate use of hydrogen quenching.

The overall conversion is maintained at a low level, less than 50 volume percent to lower boiling products, usually 340° C.− (650° F.−) products from the heavy oil feedstocks used. The conversion may, of course, be maintained at even lower levels e.g. 30 or 40 percent by volume. The degree of cracking to gas ($C_4$−) which occurs at these low conversion figures is correspondingly low and so is the conversion to naphtha (200° C.−, 400° F.−); the distillate selectivity of the process is accordingly high and overcracking to lighter and less desired products is minimized. It is believed that this effect is procured, in part, by the effect of the ammonia carried over from the first stage. Control of conversion may be effected by conventional expedients such as control of temperature, pressure, space velocity and other reaction parameters.

Surprisingly, it has been found that the presence of nitrogen and sulfur compounds in the second stage feed does not adversely affect catalyst aging provided that sufficient denitrogenation catalyst is employed. Catalyst life before regeneration in this process may typically be one year or even longer. The extended operational life of the hydrocracking catalyst in the presence of nitrogen and sulfur, present as ammonia and hydrogen sulfide, respectively, in the second stage feed is a surprising aspect of the present invention. Further, the stability of the catalyst is even more remarkable at the relatively low hydrogen partial pressures utilized in low conversion operation. Generally, the activity of cracking catalysts is adversely and severely affected by nitrogen poisoning and carbon (coke) deposition to such an extent that with an FCC catalyst, for example, the coke deposition is so rapid that regeneration must be carried out continuously in order to maintain sufficient activity. In hydrocracking, the experience is that low hydrogen partial pressures are conducive to more rapid coke accummulation as the polycyclic coke precursors undergo polymerization; higher hydrogen pressure, on the other hand, tends to inhibit coke formation by saturating these precursors before polymerization takes place. For these reasons, the excellent stability of the hydrocracking catalyst in this process is quite unexpected. When regeneration is, however, necessary e.g. after one year, it may be carried out oxidatively in a conventional manner.

The conversion of the organic nitrogen compounds in the feedstock over the hydrotreating catalyst to inorganic nitrogen (as ammonia) enables the desired degree of conversion to be maintained under relatively moderate and acceptable conditions, even with relatively nitrogenous feedstocks. Severe problems would be encountered with nitrogenous feedstocks if the hydrotreating catalyst were not used: in order to maintain the desired conversion it would be necessary to raise the temperature but if the feedstock is highly nitrogenous, it might be necessary to go to temperatures at which the hydrocracking reactions become thermodynamically unfavored. Furthermore, the volume of catalyst is fixed because of the design of the plant and this imposes limits on the extent to which the space velocity can be varied, thereby imposing additional processing restrictions. The hydrotreating catalyst, on the other hand, shifts the nitrogen content of the feedstock into inorganic form in which it does not inhibit the activity of the catalyst as much as it would if it were in its original organic form, even though some reduction in activity is observed, as mentioned above. Thus, higher conversion may be more readily achieved at reduced temperatures, higher space velocities or both. Product distribution will, however, remain essentially unaffected at constant conversion.

The present process has the further advantage that it may be operated in existing low pressure equipment. For example, if a desulfurizer is available, it may be used with relatively few modifications since the present process may be operated at low pressures comparable to the low severity conditions used in desulfurization. This may enable substantial savings in capital costs to be made since existing refinery units may be adapted to increase the pool of distillate products. And if new units are to be built there is still an economic advantage because the equipment does not have to be designed for such high pressures as are commonly used in conventional hydrocracking processes. However, minor modifications may be necessary to existing equipment in order to maintain operation within the nominal limits selected. For example, a hydrodesulfurizer may require quench installation in order to keep the temperature in the hydrocracking bed to the desired value; alternatively, an additional reactor may be provided with appropriate quenching. The precise reactor configuration used will, of course, depend upon individual requirements; the skilled person will be able to appreciate and design the plant appropriately.

Products

The hydrocracked products are low sulfur distillates, generally containing less than 0.3 weight percent sulfur. Because the degree of conversion is limited, the products contain substantial quantities of aromatics especially alkyl benzenes such as toluene, xylenes and more highly substituted methyl benzenes.

The aromatics' content will generally make the kerosine boiling distillate unsuitable for use as a jet fuel, but it may be used for blending to make diesel fuel, heating oils and other products where the aromatic content is not as critical. Although small quantities of gas and naphtha will be produced, the proportion of distillate range material will be enhanced relative to conventional processes which operate at higher pressures and higher conversion in multi-stage operations with interstage separation to remove ammonia. The removal of sulfur in the higher boiling distillate oils is usually at least 90 percent complete so that these products will readily meet specifications for non-pulluting fuel oils. The naphtha which is produced is characterized, like the other products, by a low heteroatom (sulfur and nitrogen) content and is an excellent feed for subsequent naphtha processing units, especially reforming units because of its high cycloparaffin content; the low heteroatom content enables it to be used in platinum reformers without difficulty. The present process therefore offers a way of increasing the yield of low sulfur distillate products in existing refinery equipment. In addition, because the conversion is limited, the hydrogen consumption is lower, thereby effecting an additional economy in the overall distillate production.

It is a particular and unexpected feature of the present process that distillate range products having a satisfactorily low heteroatom content may be obtained at relatively limited conversion. In conventional hydrocracking processes, the saturation is more complete and heteroatom removal proceeds correspondingly. It is therefore surprising that product specifications for nitrogen and sulfur content can be met with the more limited degree of conversion—and saturation—which is characteristic of the present process.

EXAMPLES 1-2

In this Example, the catalysts used were a conventional Ni-W-Ti, denitrogenation (DN) hydrocracker pretreatment catalyst on an amorphous silica-alumina base and a conventional Ni-W/REX/$SiO_2$/$Al_2O_3$ hydrocracking catalyst (HC), 50% REX, 50% amorphous silica-alumina. The properties of the catalysts are shown in Table 1 below.

TABLE 1

| CATALYST PROPERTIES | DN Catalyst | HC Catalyst |
|---|---|---|
| Physical Properties | | |
| Density, g./cc | 0.900 | — |
| Loose | 1.009 | — |
| Packed | 1.014 | 0.73[1] |
| Surface Area, $M^2/g$ | 277 | 331 |
| Particle Density, g/cc | 1.74 | 1.23 |
| Real Density, g./cc | 3.25 | 3.23 |
| Pore Volume cc/g. | 0.268 | 0.506 |
| Pore Diameter, Angs. | 39 | 61 |
| Crystallinity, % | — | 15 |
| Chemical Properties | | |
| Nickel, % wt. | 7.9 | 3.8 |
| Tungsten, % wt. | 21.3 | 10.4 |
| Titanium, % wt. | 4.09 | — |
| Sodium, % wt. | — | 0.33 |
| $Al_2O_3$, % wt. | 28.4 | 52[1] |
| $SiO_2$, % wt. | 27.6 | 17[1] |
| Si/Al Ratio | — | 4.97 |
| Iron, % wt. | — | 0.04 |

Note:
[1]Typical.

These catalysts were used for hydrocracking with the denitrogenation catalyst arranged in a single reactor with the hydrocracking catalyst and ahead of it. The volume ratio of the catalysts was 40:60 (DN/HC). The feedstocks used were an Arab Light Gas Oil (ALGO) of 200° C.–540° C. (400° F.–1000° F.) boiling range and a 20:80 V/V blend of the ALGO with a Coker Heavy Gas Oil (CHGO). The properties of these oils are shown in Table 2 below.

TABLE 2

FEED STOCK PROPERTIES

| Description | Arabian Light Gas Oil | Coker Heavy Gas Oil | 80/20 ALGO/ Coker |
|---|---|---|---|
| Nominal Boiling Range, °C. | 200–540 | 340–450 | 200–540 |
| Properties | | | |
| API Gravity | 31.7 | 20.3 | 29.4 |
| Sulfur, % wt. | 1.57 | 2.0 | 1.6 |
| Nitrogen, ppmw | 320 | 1500 | 500 |
| Hydrogen, % wt. | 13.01 | — | — |
| Molecular Weight | — | 306 | — |
| CCR, % wt. | 0.08 | — | — |
| Bromine Number | — | 11.8 | — |
| Aniline Point, °C. | 74.4 | 58.9 | — |
| Nickel, ppmw | — | — | — |
| Vanadium, ppmw | — | — | — |
| Viscosity, cSt @ 38° C. | 7.1 | — | — |
| Pour Point, °C. | 18 | — | — |
| Distillation, °C. | | | |
| IBP | 199 | 229 | 204 |
| 5% | 229 | — | — |
| 10% | 263 | 305 | 265 |
| 20% | 290 | 325 | — |
| 30% | 316 | 341 | — |
| 40% | 343 | 353 | — |
| 50% | 370 | 366 | 371 |
| 60% | 389 | 376 | — |
| 70% | 440 | 384 | — |
| 80% | 462 | 396 | — |
| 90% | 499 | 410 | 482 |
| 95% | 525 | 422 | — |

The conditions used for the hydrocracking are shown in Table 3 below. There was no interstage scrubbing nor liquid recycle.

TABLE 3

SINGLE STAGE HYDROCRACKING

| Example No. | 1 | 2 |
|---|---|---|
| Feed | ALGO | 80:20 ALGO/CHGO |
| Temp, °C. | 370 | 371 |
| Pressure, kPa | 10440 | 10440 |
| LHSV, $hr^{-1}$ | 0.5 | 0.5 |
| $H_2$ Circulation, $n.l.l.^{-1}$ | 1311 | 1180 |
| TOS, days | 3.0 | 23.2 |
| Total Liquid Product: | | |
| Gravity, API | 48.4 | 42.7 |
| Hydrogen, wt. percent | 14.51 | 13.23 |
| Sulfur, wt. percent | 0.096 | 0.110 |
| Nitrogen, ppm | 2 | 3 |
| Product Yields; wt. percent | | |
| $H_2S$ | 1.48 | 1.57 |
| $NH_3$ | 0.04 | 0.07 |
| $C_1$ | 0.07 | 0.06 |
| $C_2$ | 0.17 | 0.10 |
| $C_3$ | 1.12 | 0.82 |
| i-$C_4$ | 1.26 | 0.84 |
| n-$C_4$ | 2.30 | 1.30 |
| i-$C_5$ | 2.68 | 1.66 |
| n-$C_5$ | 0.52 | 0.39 |
| 52° C.–82° C. | 1.2 | 1.9 |
| 82° C.–143° C. | 11.7 | 9.4 |
| 143° C.–202° C. | 12.6 | 10.9 |
| 202° C.–260° C. | 22.1 | 20.8 |
| 260° C.–340° C. | 22.5 | 22.6 |
| 340° C.+ | 22.0 | 28.5 |
| Product Yields, Vol. Percent: | | |
| i-$C_4$ | 3.53 | 2.01 |
| n-$C_4$ | 1.87 | 1.27 |
| i-$C_5$ | 0.72 | 0.55 |

TABLE 3-continued

SINGLE STAGE HYDROCRACKING

| Example No. | 1 | 2 |
|---|---|---|
| Feed | ALGO | 80:20 ALGO/CHGO |
| n-$C_5$ | 3.72 | 2.34 |
| 52° C.–82° C. | 1.55 | 2.33 |
| 82° C.–143° C. | 14.06 | 10.83 |
| 143° C.–202° C. | 13.76 | 11.89 |
| 202° C.–260° C. | 23.87 | 22.39 |
| 260° C.–340° C. | 24.21 | 24.11 |
| 340° C.+ | 22.93 | 29.59 |
| $H_2$ Consumption, $n.l.l.^{-1}$ | 171 | 95 |
| Liquid Vol. Conversion, %[1] | | |
| 200° C.– | 38.3 | 30.5 |
| 340° C.– | 46.8 | 38.4 |
| Wt. Conversion, %[2] | | |
| 200° C.– | 32.8 | 26.8 |
| 340° C.– | 39.7 | 33.3 |

Notes:
[1]Vol. percent in product minus vol. percent in feed
[2]Wt. percent in product minus wt. percent in feed and $H_2S$ and $NH_3$ Yield.

EXAMPLES 3–4

The single stage hydrocracking process of the present invention was compared to a similar process using only a single hydrocracking catalyst without the initial denitrogenation step. The feedstock was a 80:20 volume blend of the ALGO and HCGO described above. The conditions and results are shown in Table 4 below.

TABLE 4

Yield Comparison for Single and Two Catalyst Systems

| Example No. | 3 | 4 |
|---|---|---|
| Catalyst | HC | DN and HC |
| Run Conditions: | | |
| Temperature, °C. | 396 | 394 |
| Pressure, kPa | 10440 | 10440 |
| LHSV, $Hr.^{-1}$ | 1.0 | 0.6 |
| $H_2$ Circulation, $n.l.l.^{-1}$ | 759 | 1079 |
| TOS, Days | 16.9 | 31.2 |
| Total Liquid Product: | | |
| Gravity, API | 43.0 | 66.1 |
| Hydrogen, Wt. Percent | 13.82 | 14.84 |
| Sulfur, Wt. % | 0.130 | 0.020 |
| Nitrogen, PPM | 2 | 1 |
| Product Yields, Wt. % | | |
| $H_2S$ | 1.55 | 1.66 |
| $NH_3$ | 0.07 | 0.07 |
| $C_1$ | 0.03 | 0.16 |
| $C_2$ | 0.22 | 0.51 |
| $C_3$ | 1.08 | 4.07 |
| i-$C_4$ | 1.23 | 9.18 |
| n-$C_4$ | 1.13 | 5.31 |
| i-$C_5$ | 1.66 | 10.45 |
| n-$C_5$ | 0.50 | 2.91 |
| 52° C.–82° C. | 3.0 | 11.3 |
| 82° C.–143° C. | 10.2 | 30.7 |
| 143° C.–202° C. | 11.4 | 12.8 |
| 202° C.–260° C. | 16.0 | 7.5 |
| 260° C.–340° C. | 27.8 | 4.8 |
| 340° C.+ | 25.7 | 1.8 |
| $H_2$ Consumption, $n.l.l.^{-1}$ | 165 | 330 |
| Liquid Vol. Conversion, % | | |
| 200° C.– | 34.2 | 105.6 |
| 340° C.– | 41.7 | 80.9 |

EXAMPLE 5

The Example illustrates the operation of the process in existing refinery equipment designed for conventional desulfurization of vacuum gas oil.

The equipment used is subject to the following design restrictions shown in Table 5 below.

TABLE 5

| Design Operating Conditions - VGO Desulfurizer | |
|---|---|
| Capacity | 5090 $M^3$ $day^{-1}$ |
| No. of reactors | 2, parallel |
| Catalyst vol. per reactor | 212 $m^3$ |
| Pressure, total | 6685 kPa |
| $H_2$ Circulation | 545 n.l.l.$^{-1}$ |
| LHSV | 0.50 |
| Reactor Temp., max. | 425° C. |
| Catalyst type | Co—Mo |

The vacuum gas oil feedstock for hydrocracking had the following composition shown in Table 6 below.

TABLE 6

| Feedstock Properties | |
|---|---|
| Nominal Boiling Range, °C. | 300–510° |
| API Gravity | 23.4 |
| Sulfur, wt. percent | 2.3 |
| Nitrogen, ppmw | 550 |
| Hydrogen, wt. percent | 12.46 |
| CCR, wt. percent | 0.17 |
| Aniline pt., °C. | 80.6 |
| Pour pt., °C. | 35 |
| Distillation, (vol. percent), °C. | |
| IBP | 294 |
| 5 | 335 |
| 10 | 353 |
| 20 | 376 |
| 30 | 394 |
| 40 | 411 |
| 50 | 426 |
| 60 | 440 |
| 70 | 456 |
| 80 | 473 |
| 90 | 493 |
| 95 | 505 |

The desulfurizing unit is designed to achieve 90 percent desulfurization with a conventional Co-Mo on alumina catalyst. In adapting the unit for use with the present process, the desulfurization catalyst was removed and replaced with a 25:75 combination of a hydrotreating (denitrogenation) catalyst and a hydrocracking catalyst. The hydrotreating catalyst used was a commercially available Ni-Mo on alumina catalyst (Cyanamid HDN-30) and the hydrocracking catalyst was the same as used in Examples 1 to 4.

The vacuum gas oil feedstock was subjected to hydrocracking over the 25:75 catalyst combination under the conditions shown in Table 7 below, with the results shown in the table. No interstage separation or liquid recycle was used.

TABLE 7

| Hydrocracking over 25:75 catalyst combination | | |
|---|---|---|
| Temp., °C. | 400 | |
| Pressure, kPa[1] | 5860 | |
| LHSV, $hr^{-1}$ | 0.5 | |
| $H_2$ circulation, n.l.l.$^{-1}$ | 535 | |
| Time on stream, days | 44 | |
| Product Yields[2] | Wt. percent | Vol. percent |
| $H_2S$ | 2.40 | — |
| $NH_3$ | 0.07 | — |
| $C_1$ | 0.30 | — |
| $C_2$ | 0.38 | — |
| $C_3$ | 0.81 | — |
| i-$C_4$ | 0.55 | 0.89 |
| n-$C_4$ | 0.82 | 1.27 |
| i-$C_5$ | 0.84 | 1.23 |
| n-$C_5$ | 0.36 | 0.51 |
| $C_6$–193° C. | 13.03 | 15.13 |
| 193°–343° C. | 24.04 | 25.26 |
| 343°–413° C.[3] | 20.98 | 22.32 |
| 413° C.+ | 36.34 | 38.26 |
| | 100.92 | 104.87 |
| $H_2$ Consumption, n.l.l.$^{-1}$ 98 | | |

Notes:
[1]Pure hydrogen
[2]Cuts based on actual TBP distillation yields
[3]343° C. conversion $= 100 \times \frac{(90\text{–}343° \text{ C.} + \text{yield})}{90} = 36.3$ wt. percent The detailed product properties for the nominal 35 percent conversion are shown in Table 8 below.

TABLE 8

| Product Properties for Nominal 35 PCT Conversion | | | | | | | |
|---|---|---|---|---|---|---|---|
| Nominal Boiling Range, °C. | $C_6$–166 | 166–205 | 194–270 | 270–288 | 194–344 | 344–413 | 413+ |
| Properties | | | | | | | |
| Gravity, °API | 49.0 | 42.0 | 34.0 | 30.5 | 32.0 | 33.0 | 31.3 |
| Molecular Wt. | 109 | 134 | — | — | — | 316 | 433 |
| Aniline Pt., °C. | — | — | — | — | 49 | 91 | — |
| CCR, wt % | — | — | — | — | — | — | 0.03 |
| Pour Pt., °C. | — | — | -54 | — | — | 21 | 40 |
| Viscosity, CS @ 55° C. | — | — | — | — | — | 19.63 | 19.81 |
| Viscosity, CS @ 10° C. | — | — | — | — | — | — | 6.03 |
| R + O Octane | 78 | 78 | — | — | — | — | — |
| Smoke Pt., ° | — | — | 12.0 | — | — | — | — |
| Cetane Index | — | — | — | — | 44 | — | — |
| Hydrogen, wt. % | — | — | 12.40 | 12.42 | 12.57 | 13.59 | 13.76 |
| Sulfur, wt. % | — | — | 0.002 | 0.006 | 0.008 | 0.03 | 0.03 |
| Nitrogen, ppmw | — | —5 | — | 1.3 | 4.5 | 22 | |
| Composition, wt. % | | | | | | | |
| Paraffins | 31.0 | 30.2 | — | 21.4 | 27.5 | 39.6 | 38.0 |
| Cyclo-Paraffins | 33.4 | 27.2 | — | 26.0 | 25.7 | 31.7 | 35.2 |
| Aromatics[1] | 35.5 | 42.6 | 54.4 | 52.6 | 47.8 | 28.7 | 26.8 |
| Distillation Type[2] | D86 | D86 | D2887 | D2887 | D86 | D1160 | D1160 |
| IBP, °C. | 98 | 150 | 176 | 218 | 199 | 352 | 391 |
| 10% | 109 | 162 | 197 | 254 | 218 | 360 | 427 |
| 30% | 117 | 166 | 215 | 272 | 242 | 368 | 438 |
| 50% | 125 | 170 | 232 | 284 | 269 | 376 | 451 |
| 70% | 136 | 177 | 249 | 289 | 294 | 383 | 470 |
| 90% | 153 | 189 | 268 | 294 | 314 | 396 | 505 |
| EP | 164 | 207 | 307 | 310 | 326 | — | — |

Notes:
[1]Aromatics + Olefins, % vol.
[2]ASTM designation.

The results given in Table 7 above show that the nominal 35 percent conversion to 345° C— (650° F.—)

products (conversion based on actual TBP distillation yields) was achieved within the operating ranges allowed by the design of the unit. The results in Table 8 show that the hydrocracked products below 345° C. (650° F.) tend to be high in aromatics. The aromatics content is not excessive for many uses and the products are therefore valuable. The naphtha is an excellent reformer (PtR) feed because of its high cycloparaffin content, the light and heavy distillates are premium products because of their very low sulfur and nitrogen contents and are unique in this respect. The process is therefore capable of producing prime quality products without the costly disadvantage of over-hydrogenation that would be experienced at high pressure.

Figure 3:
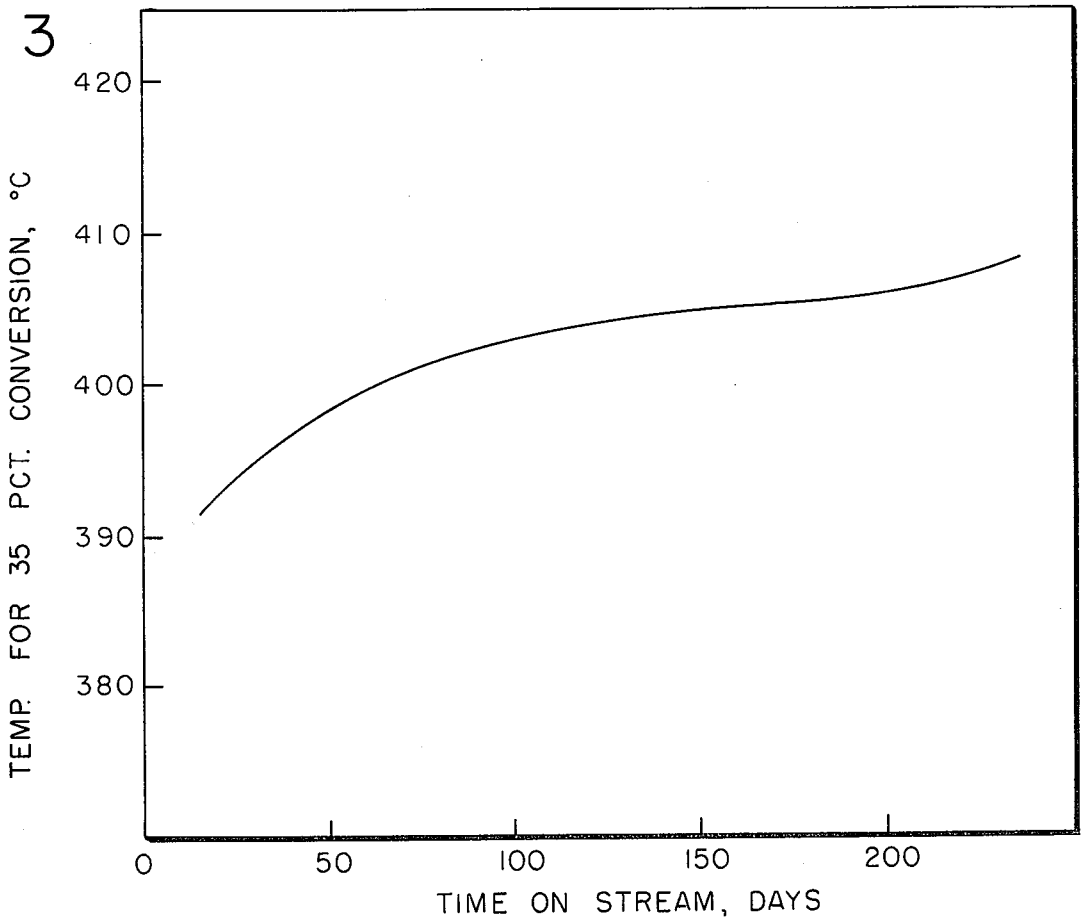
FIG. 3 is a graph relating the reaction temperature to the time on stream for the process.

The hydrocracking was continued for about eight months on stream, with the temperature being adjusted to maintain a constant 35 percent nominal conversion. The results are shown in FIG. 3 and demonstrate that the catalyst is stable over a long period of time and that the final required temperature remained well below the maximum design temperature of the reactor.

We claim:

1. A hydrocracking process of improved distillate selectivity which comprises:

(i) passing a hydrocarbon feedstock comprising a heavy gas oil having an initial boiling point of at least 340° C. containing nitrogenous and sulfurous impurities over a hydrotreating catalyst in the presence of hydrogen at elevated temperature and at a pressure of not more than 7000 kPa to hydrotreat the feedstock, (ii) passing the hydrotreated feedstock without intermediate separation or liquid recycle over a hydrocracking catalyst in the presence of hydrogen at elevated temperature and at a pressure of not more than 7000 kPa to hydrocrack the feedstock at a volume conversion of less than 50 percent to produce a distillate boiling range product.

2. A process according to claim 1 in which the hydrocracking catalyst comprises a metal component of a base metal of Groups VIA or VIII of the Periodic Table on an acidic, crystalline zeolite carrier.

3. A process according to claim 1 which is carried out at a pressure of 5250 to 7000 kPa.

4. A process according to claim 1 in which the volume conversion is 30 to 40 volume percent to 345° C.—(650° F.—) products.

5. A process according to claim 1 in which the volume ratio of the hydrotreating catalyst to the hydrocracking catalyst is from 25:75 to 75:25.

6. A process according to claim 5 in which the volume ratio of the hydrotreating catalyst to the hydrocracking catalyst is from 40:60 to 60:40.

7. A process according to claim 1 in which the hydrotreating catalyst comprises a metal component of a base metal of metals of Groups VIA or VIIIA of the periodic Table on an amorphous carrier.

8. A process according to claim 7 in which the base metal or metals is selected from vanadium chromium, titanium, tungsten, cobalt, nickel and molybdenum.

9. A process according to claim 7 in which the metal component comprises cobalt-molybdenum, nickel-molybdenum, nickel-tungsten or nickel-tungsten-titanium.

10. A process according to claim 7 in which the carrier comprises amorphous alumina or amorphous silica-alumina.

11. A process according to claim 2 in which the zeolite carrier comprises zeolite X, zeolite Y, or mordenite.

12. A process according to claim 2 in which the base metal or metals is selected from vanadium, chromium, titanium, tungsten, cobalt, nickel and molybdenum.

13. A process according to claim 2 in which the metal component comprises cobalt-molybdenum, nickel-molybdenum, nickel-tungsten or nickel-tungsten-titanium.

14. A method of operating a hydrocracking process within existing low pressure petroleum refinery unit which comprises hydrotreating a hydrocarbon feedstock comprising a heavy gas oil having an initial boiling point of at least 340° C. containing organic nitrogenous and sulfurous impurities over a hydrotreating catalyst in the presence of hydrogen at a pressure up to 7000 kPa and a temperature up to 450° C. in the unit to convert the organic nitrogen and sulfur to inorganic form, and passing the hydrotreated products without intermediate separation or liquid recycle over a hydrocracking catalyst at a pressure up to 7000 kPa and a temperature up to 450° C. and at a volume conversion of less than 50 percent to form an aromatic-containing distillate boiling range hydrocracked product.

* * * * *

UNITED STATES PATENT AND TRADEMARK OFFICE

CERTIFICATE OF CORRECTION

PATENT NO. : 4,435,275

DATED : March 6, 1984

INVENTOR(S) : Derr et al

It is certified that error appears in the above—identified patent and that said Letters Patent is hereby corrected as shown below:

Column 1, line 18, "polycyclin" should be --polycyclic--.

Column 1, line 23, "by" should be --be--.

Column 5, line 37, "cnvert" should be --convert--.

Column 7, line 56, after "appreciate" insert --these--.

Column 12, Table 8, line beginning "Nitrogen, ppmw" should read

-- - - 5 - 1.3 4.5 22--.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*